US006705325B1

(12) United States Patent
Hicks et al.

(10) Patent No.: US 6,705,325 B1
(45) Date of Patent: Mar. 16, 2004

(54) APPARATUS FOR MAKING CIGARETTE WITH BURN RATE MODIFICATION

(75) Inventors: Douglas R. Hicks, McDonough, GA (US); Joseph T. Wanna, Macon, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 68 days.

(21) Appl. No.: 10/389,072

(22) Filed: Mar. 14, 2003

Related U.S. Application Data

(63) Continuation-in-part of application No. 10/299,231, filed on Nov. 19, 2002.

(51) Int. Cl.[7] ..... A24C 5/46

(52) U.S. Cl. ..... 131/34; 131/33; 131/36; 131/60; 131/67

(58) Field of Search ..... 131/280, 32, 33, 131/34, 36, 58, 60, 67; 226/195; 83/302, 924, 937, 931, 949, 952, 176; 242/522, 525, 525.1; 156/259, 265, 519

(56) References Cited

U.S. PATENT DOCUMENTS

| | | | | |
|---|---|---|---|---|
| 3,165,105 A | | 1/1965 | Campbell | |
| 3,526,231 A | | 9/1970 | Verbakel et al. | |
| 4,336,812 A | | 6/1982 | Seragnoli | |
| 4,666,550 A | * | 5/1987 | Spiers et al. | 156/361 |
| 5,156,169 A | | 10/1992 | Holmes et al. | |
| 5,169,481 A | | 12/1992 | Braunshteyn et al. | |
| 5,200,020 A | | 4/1993 | Collins et al. | |
| 5,398,702 A | | 3/1995 | Belvederi | |
| 6,129,087 A | | 10/2000 | Wallace et al. | |
| 6,142,154 A | | 11/2000 | Dall'Osso et al. | |
| 2002/0185143 A1 | | 12/2002 | Crooks et al. | |

* cited by examiner

*Primary Examiner*—Dionne A. Walls
(74) *Attorney, Agent, or Firm*—John F. Salazar; Middleton Reutlinger

(57) ABSTRACT

A cigarette making machine for manufacturing of a cigarette with burn rate modification is described. The cigarette maker allows for mounting of a special bobbin of material which is different in size and width of a normal wrapper bobbin and feeds both the outer wrap web of material and narrower inner wrap web of material to the garniture. A slitting device may be utilized to cut the inner wrap web of material into a plurality of individual strips which are placed adjacent the outer wrap web of material in the garniture area of the maker. The inner wrap web of material may derive from a transverse wound bobbin in order to store large linear amounts of inner wrap web material.

31 Claims, 8 Drawing Sheets

APPARATUS FOR MAKING CIGARETTE WITH BURN RATE MODIFICATION

CROSS-REFERENCE TO PRIOR APPLICATION

This application is a continuation-in-part of U.S. patent application Ser. No. 10/299,231, filed Nov. 19, 2002.

TECHNICAL HELD

The present invention relates to a cigarette having a modified burn rate and a cigarette making apparatus for manufacturing such a cigarette. The modifications to the cigarette of the present invention include changes to the wrapper of the cigarette paper such that the tobacco column of the cigarette is adjacent to a strip wrap forming co-axial zones of high diffusion areas and co-axial zones of low diffusion areas. Such a partial double wrap cigarette exhibits a modified burn rate such that the standard smolder rate of the cigarette may be changed as desired to either self extinguish or slowed significantly depending upon the desired outcome.

DETAILED DESCRIPTION OF THE PREFERRED EMBODIMENTS

Figure 1:
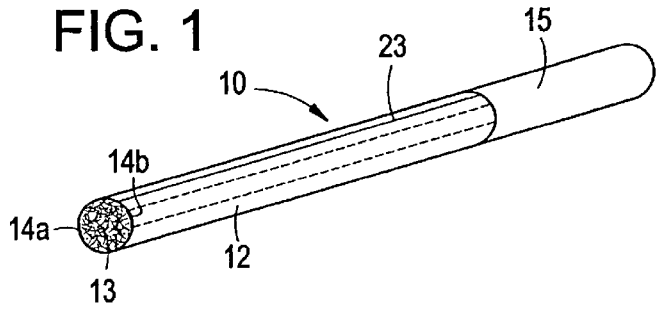
FIG. 1 is a perspective view of the partial double wrap cigarette with modified burn rate of the present invention.

A cigarette with burn rate modification is shown in FIG. 1 and may be described as a partial double wrap cigarette 10. As seen therein, the partial double wrap cigarette 10 of the present invention incorporates a standard column of tobacco 13 which extends from an exposed end to the filter 15. Circumscribing the tobacco column 13 is the outer wrap of the cigarette paper 12. Interior of the outer wrap cigarette paper 12 is a separate partial inner wrap layer or strip 14*a* and 14*b*. The separate partial inner wrap layer 14*a* and 14*b* acts as a burn rate modifier for the tobacco column 13 by altering the burn characteristics of the cigarette 10. As can be seen from the embodiment shown in FIG. 1, the inner wrap layer strips may be co-axial to the tobacco column 13 and may extend substantially the length of the tobacco column from the exposed end to the filter 15. By insertion of the separate partial inner wrap layer 14*a* and 14*b* which in this embodiment extends co-axial to the tobacco column 13, modification may be made to the burn rate of the cigarette in such a manner that the burn rate may be adjusted depending upon the packing density of the tobacco, porosity of the outer wrap paper 12 and additives to the outer wrap, width of the separate partial inner wrap layer 14*a* and 14*b*, porosity of the inner wrap layers 14*a* and 14*b*, and additives to the inner wrap strips. Alternatively, the inner wrap layer may be shortened to not extend the full length of the tobacco column 13 or may extend in varying directions. Thus, many alterations to the burn rate of the partial double wrap cigarette 10 of the present invention may be established based upon the combination of factors noted herein, among others.

As depicted in FIG. 1, the partial double wrap cigarette 10 of the present invention which has a modified burn rate characteristic incorporates an outer wrap paper 12 with a first and a second separate partial inner wrap strip 14*a* and 14*b*. The outer wrap cigarette paper 12 may be a normal porosity paper which typically exhibits a porosity of 15–80 Coresta units. In combination with the outer wrap cigarette paper 12 is positioned at least one partial inner wrap layer which can modify the burn rate characteristics of the cigarette 10. As shown, a first and a second partial inner wrap layer 14*a* and 14*b* are provided on opposite sides of the tobacco column 13. In order to provide substantially equivalent burn rate characteristics along the entirety of the tobacco column 13, the partial inner wrap strips 14*a* and 14*b* may substantially extend and be co-axial with the tobacco column 13 to the filter 15.

Figure 4:
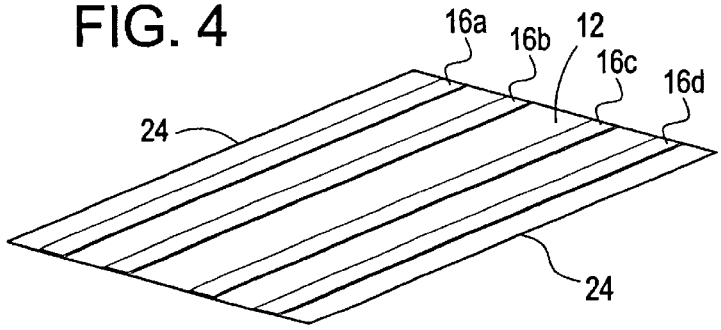
FIG. 4 is a perspective view of the partial double wrap for a cigarette with modified burn rate of the present invention.

As depicted in the embodiment of FIG. 4, the partial inner wrap layers 14*a* and 14*b* extend from end to end of the tobacco column 13 and may be positioned such that they are either equal distant from each other or may be placed in alternative positions based upon the desired burn rate characteristics.

Figure 3:
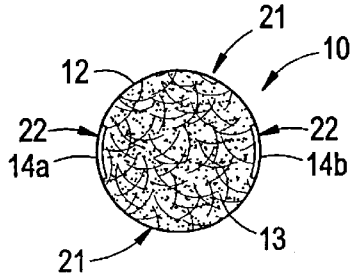
FIG. 3 is an end view of the cigarette with modified burn rate of the present invention.

Turning to FIG. 3, it is apparent that the partial double wrap cigarette 10 of the present invention has alternating high diffusion areas 21 and low diffusion areas 22 based upon the placement of the inner wrap layers or strips 14*a* and 14*b*. As can be seen, the high diffusion areas 21 of which there is at least one, allow for increased permeation of CO and oxygen gases through the barrier formed by the outer wrap 12 while maintaining normal deliveries. In combination, low diffusion areas 22 which are defined by the circumferential extent of each of the partial inner wrap layers 14*a* and 14*b* may potentially block a significant portion or all of the inflow and outflow of gases therethrough related directly to the porosity of the inner wrap layer 14*a* and 14*b* in combination with the outer wrap layer 12. The co-linear zones of high diffusion area 21 and low diffusion area 22 may exhibit a porosity of greater than 14 Coresta for the co-linear high diffusion areas and less than 8 Coresta for the co-linear low diffusion areas.

Figure 2:
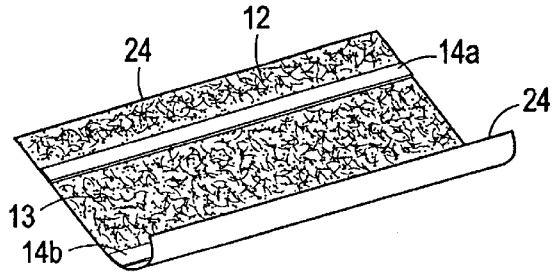
FIG. 2 is a perspective view of the unrolled cigarette paper of the unrolled outer wrapper of the cigarette having a partial double wrap with modified burn rate as shown in FIG. 1.

As shown in the drawings, the construction of the cigarette with burn rate modification is a partial double wrap cigarette 10 depicted herein and utilizes a standard outer wrap cigarette paper 12 which, in a typical cigarette, is 27 mm wide. Placed along the interior of the outer wrap, as shown in FIG. 2 and in FIG. 4 in an alternative embodiment, is located the separate partial inner wrap layer 14*a* and 14*b* which may substantially extend along the length of the outer wrap 12. While the outer wrap of the cigarette paper may be standard porosity and construction, the partial inner wrap of this embodiment has a first and a second strip 14*a* and 14*b* each of which may be 4 mm in width and which may have a porosity of less than 8 Coresta units. Therefore, combined, the two inner wrap layers or strips 14*a* and 14*b* may circumscribe about 8 mm of the circumference of the partial double wrap cigarette 10 of the present invention but may extend around a circumference of up to 15 mm of the tobacco column in relation to a standard cigarette dimension. Any combination of the partial inner wrap and outer wrap may work depending on the variables noted, such as porosity of each paper, but it is felt that good burn rate characteristics as well as limited effects to smoke characteristics and flavor may be achieved by incorporating an inner wrap which covers less than about 75% or preferably less than about 60% and even more preferably less than about 35% of the circumference of the outer wrap. This is a function of the overall cigarette and may vary depending on the circumference of the outer wrap. However, variations are available to achieve the same favorable results utilizing the inventive aspects of the present design and such descriptions are not felt to be limiting and are exemplary only.

Alternatively, many different constructions may be utilized to provide the cigarette with burn rate modification as set forth herein. As may be understood, a single inner wrap layer or a plurality of inner wrap layers may be provided based upon the desired characteristics and burn rate modification. Thus, as previously mentioned, combinations of low porosity inner wrap segments and higher porosity outer wrap segments may be utilized to provide various linear burn rates which may be desirable. Thus, a typical linear burn rate of 6.0 mm per minute may be reduced as desired based upon a combination of porosity of outer wrap and partial inner wrap strips among other factors and may readily be reduced to below 4 mm/minute if needed. This includes formulation of single inner wrap strips of lower porosity or replacement of the inner wrap strips with various construction material including reconstituted tobacco, low porosity paper, bandcast tobacco, a polymer based material, other paper or material. The inner wrap strips may be coated with burn modifiers or other materials which would create at least one low diffusion area along the tobacco column. The paper may be coated with, as an example, sodium alginate as a burn inhibitor in order to decrease the porosity of the paper and provide adequate characteristics such that the entire combination of outer wrap porosity, tobacco packing density, inner wrap circumference covered and number of strips, inner wrap porosity and other factors cause the cigarette to exhibit a desired burn rate.

As shown in FIGS. 4–7, various embodiments may be utilized in order to create the low porosity zone. As depicted in FIG. 4, the opened standard outer wrap 12 is lined with a plurality of inner wrap or inner layer strips 16*a*, 16*b*, 16*c* and 16*d*. These strips may be placed equidistantly apart along the interior of the outer wrap 12 and positioned away from the edges or seam where the outer wrap is adhered to itself during rolling within the garniture of the cigarette maker. As depicted, the strips 16*a*–16*d* may all be fed into the garniture and incorporated on the interior of the outer wrap adjacent the tobacco column. Placement of the partial inner wrap strips modifies the burn rate to a desired level such that the rate may be decreased sufficiently to cause either a significantly reduced static burn rate or self-extinguishment at a desired interval.

Figure 5:
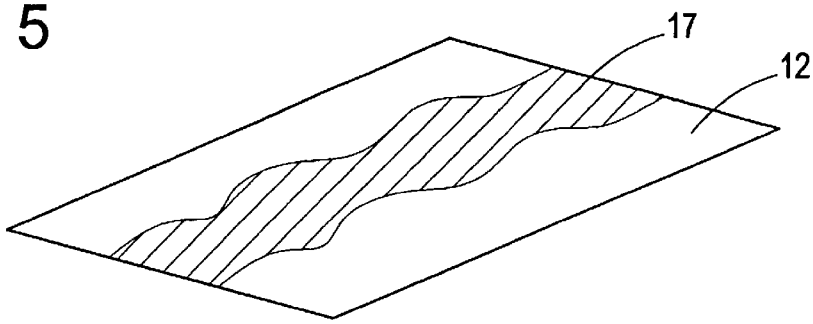
FIG. 5 is an alternative embodiment for a partial double wrap design for the present invention.

As shown in FIG. 5, an inner layer with non-linear sides 17 as compared to the edges of the outer wrap 12 may be utilized as the partial inner wrap in order to create the low porosity zone. As shown therein, the inner wrap layer 17 may be in wave form so that the placement of the low porosity zone changes in position along the tobacco column axis. Such non-linear placement of the low porosity zone may allow for different positioning of the cigarette during static burn and insure that the desired static burn rate takes effect regardless of the position of the cigarette.

Figure 6:
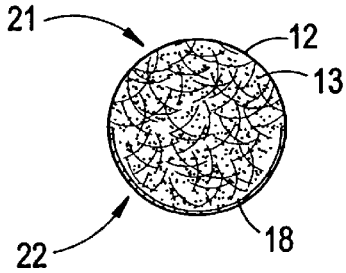
FIG. 6 is a front view of an alternative embodiment for the cigarette with burn rate modification of the present invention.

Depicted in FIG. 6 is another embodiment of the cigarette with burn rate modification of the present invention. As seen therein, a high diffusion area 21 and low diffusion area 22 is defined by addition of a partial double wrap inner wrap layer 18 which circumscribes a portion of the tobacco column 13 on the interior of outer wrap 12. The partial inner wrap layer 18, as depicted in the figure, extends approximately half way around the perimeter of the tobacco column 13. However, many different configurations may be utilized in order to achieve the appropriate linear burn rate through the burn rate modification set forth. The partial double wrap inner wrap layer 18 may be comprised of standard cigarette paper which has a low porosity of less than 7 Coresta units or cigarette paper coated with burn rate modifiers, or may be alternative construction such as a bandcast tobacco sheet with or without additives and which typically has a low Coresta unit value, typically less than 5 and more preferably less than 3. A secondary benefit of utilizing bandcast or reconstituted tobacco sheets as the partial double wrap inner wrap layer 18 is that the coloring of the inner wrap may be such that it is similar to the tobacco column 13 and does not provide a contrastly whitened area which extends along the low diffusion area 22. Additionally, a polymer film or other material may be used as the partial double wrap inner wrap layer 18. It may be preferable for the partial double wrap inner layer displayed in FIG. 6 to be 2–14 mm in width or alternatively, less than 75% of the circumference of the outer wrap in order to obtain the appropriate burn rate modification desired wherein the linear burn rate is sustained at a low enough level, preferably below 4.0 mm per minute.

Figure 7:
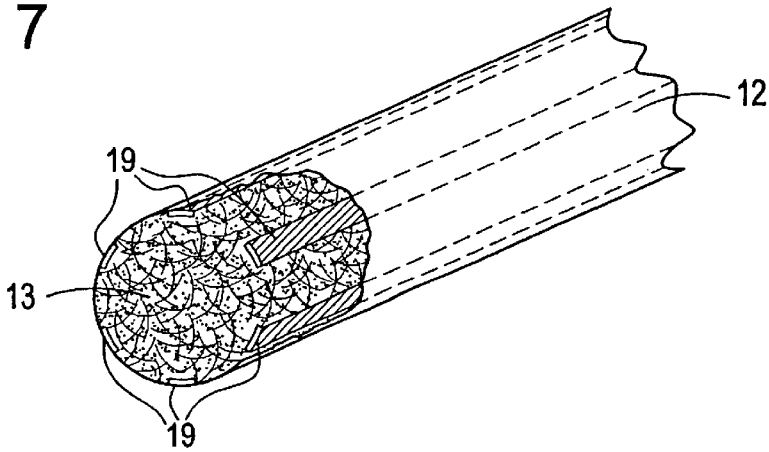
FIG. 7 is a partial cut away view for an alternative embodiment of the cigarette with burn rate modification of the present invention.

As depicted in FIG. 7, an alternative embodiment is disclosed wherein a plurality of inner wrap strips 19 are utilized substantially surrounding the tobacco column 13 on the interior of the outer wrap 12. The plurality of inner wrap strips 19 may be fed into the garniture adjacent the outer wrap 12 and encircling the tobacco column 13 as it is formed within the cigarette maker. The plurality of strips 19 may be comprised of a low porosity cigarette paper individually fed into the cigarette maker or by a single or multiple strips fed into the cigarette maker adjacent to the garniture and cut to the appropriate strip widths. As depicted in FIG. 7, a plurality of inner wrap strips 19 are utilized and extend co-axially substantially along the length of the tobacco column 13. Preferably, the plurality of strips 19 extend along the entire tobacco column length such as to modify the burn rate along the entire tobacco column regardless of cigarette positioning. It is felt that by providing a plurality of strips 19 as depicted in FIG. 7, a more even modification of the burn rate of the cigarette may be produced.

As may be appreciated, extending the inner wrap layer substantially along the length of the tobacco column 13 such that they are co-axial provides a significant benefit over alternating rings which are perpendicular to the axis of the tobacco column 13. Such perpendicular rings which alternate along the length of the tobacco column may provide a non-linear burn rate of the tobacco column 13. Thus, in such a design where there are circumscribing rings around the tobacco column, the linear burn rate becomes variable between a low linear burn rate to a high linear burn rate depending upon the porosity of the paper at the point of the rings as opposed to the porosity of the non-adjusted paper between the rings. Such non-linear burn rate may in fact be undesirable in that continued free burning of the tobacco column between the rings for significant periods of time does not produce an appropriate burn rate modification which can be depended upon through the entire tobacco column length. Further, at points where the low porosity rings are present, a smoker may puff on the cigarette as the burning of the tobacco column passes over a low porosity ring. At such a point, it is thought that the deliveries of the cigarette may be altered significantly to increase the CO and other compounds provided as the cigarette burns over one of these rings. Thus, the partial double wrap inner layer of the present invention overcomes these problems by providing known standard deliveries over the entire length of the tobacco column while also modifying the burn rate along the entire co-axial length.

In the design of the cigarette with the burn rate modification 10 of the present invention, it may be desirable to incorporate the inner wrap layers, whether a plurality of strips or a single layer, away from the seam of the outer wrap 12. As is known in cigarette manufacturing, the seam 23, depicted in FIG. 1, is formed by the maker by over-wrapping the side edges 24 of the outer wrap 12. In typical cigarette manufacturing, an adhesive is applied along one of the edges 24 prior to folding of the outer wrap and formation of the tobacco column 13. During manufacturing of the cigarette with burn rate modification 10 of the present invention, it is desirable to maintain the partial inner wrap layer away from the seam portion to assure that the outer wrap 12 is properly formed and the partial inner wrap layer does not intercede in the formation of the tobacco column or adhesive of the outer wrap layer. Thus, as depicted in the embodiments, the partial inner wrap layers are shown to be placed away from the side edges 24 so that the inner wrap portions will not interfere with the seam of the outer wrap 12 nor interfere with the formation of the tobacco column within the garniture in a typical cigarette manufacturing machine. Thus, the cigarette with burn rate modification of the present invention may be implemented on standard cigarette making machines with only minor modifications made to the paper feeding devices and no modifications therefore will necessarily be required within the garniture. It is also apparent that in any of the embodiments shown herein the strips may be alternatively placed on the exterior of the cigarette and retained on the wrapper by adhesives or other means so that there are still formed co-linear zones of high and low porosity.

Figure 8:
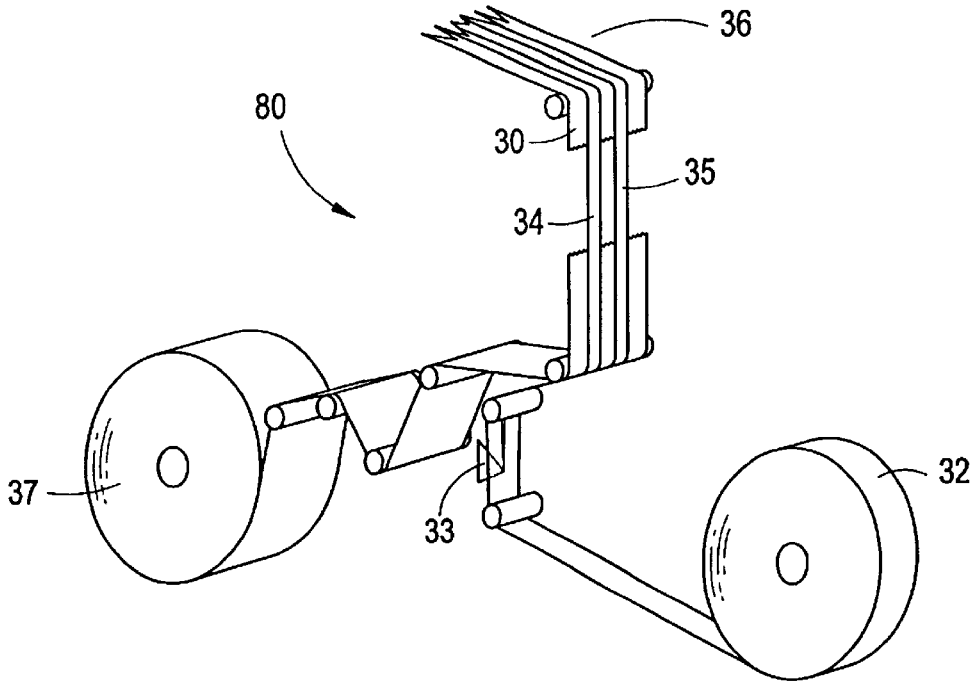
FIG. 8 is a perspective view of the cigarette paper feeder on a cigarette making machine for use with the present invention.

As shown in FIG. 8, a sample design for manufacturing a cigarette with burn rate modification described herein is depicted. The paper feeding assembly 80 is comprised of two paper sources, the outer wrap bobbin 37 and the inner wrap or inner strip bobbin 32. The outer wrap bobbin 37 may be comprised of standard porosity outer wrap cigarette paper having a standard width which may vary between 19–27 mm as may be normally the case and may be fed to the cigarette making machine through a plurality of rollers and tensioning guides. In the embodiment shown, the partial inner wrap and outer wrap layer may be combined to form a combined cigarette paper 36 wherein the outer wrap and inner wrap layer receive the tobacco within the garniture. The outer wrap layer 30 may underlie the partial inner wrap strips 34, 35 which are fed from the inner wrap strip bobbin 32 or other source. The inner wrap strip bobbin 32 may be narrower than the outer wrap as it is intended to cover only a portion of the inner surface of the outer wrap 30. The inner wrap strip bobbin 32 may be unrolled and fed through rollers and cut by a knife into the desired strips prior to forming the combined cigarette paper 36 just preceding the garniture. The strips 34, 35 which form the inner wrap portion of the cigarette of the present invention may have significantly different burn rate characteristics than the outer wrap 30. Thus, variations in the porosity, content and other characteristics may be provided by supplying dual bobbins at the machine in the present embodiment. The slitter 33 may be provided to slit the inner wrap paper into two or more strips.

As shown in FIG. 8, the inner wrap strip bobbin 32 may have a paper with a width of 4–15 mm which is slit in two strips. The correct combination of porosity and burn characteristics of the inner wrap and outer wrap layer may be adjusted so as to produce an appropriate burn rate modification which is desirable to produce a standard linear burn rate throughout the entirety of the cigarette and tobacco column.

As shown in FIG. 8, the paper feeding assembly 80 disclosed incorporates a number of tensioning rollers for providing adequate feeding of the outer wrap 30 and the partial inner wrap strips 34, 35 to produce the combined cigarette wrapping paper 36. As may be appreciated, the smaller width bobbin 32 creates significantly more problems in feeding the slit paper to the garniture. Adequate tensioning of the strips 34, 35 must be provided in order to prevent tearing of the inner wrap strips 34, 35 prior to the garniture. Additionally, as cigarette manufacturing process is inherently a stop and go procedure, the proper tensioning of the outer wrap bobbin 37 and inner wrap strip bobbin 32 is necessary. Thus, the partial inner wrap strips 34, 35 may be combined with the outer wrap paper 30 just prior to the garniture or may be combined, as depicted in FIG. 8, immediately after slitting in order to provide proper tensioning and combination of the two layers.

Figure 9:
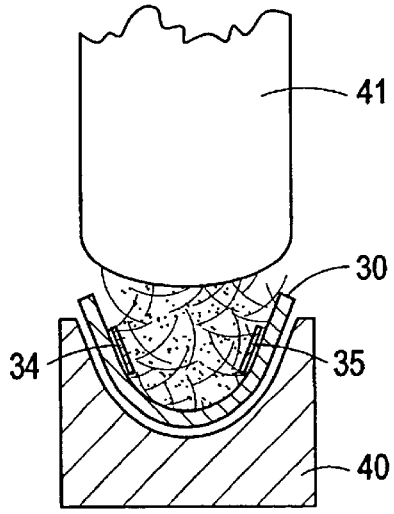
FIG. 9 is an end sectional view of the garniture area of a cigarette making machine for use with the present invention.

Turing to FIG. 9, a cross section of the garniture within the cigarette maker is shown. The garniture 40 is the area within the cigarette maker wherein the cigarette is rolled and formed. There is usually a belt which lies between the outer wrap 30 and the garniture 40 but which is not shown herein for explanation purposes. As depicted, the garniture 40 has a curvature for formation of the tobacco column and cigarette. The curvature folds the outer wrap 30 around the tobacco after the tobacco is deposited by the tobacco provider 41 within the cigarette maker. Prior to entry within the garniture, the inner wrap strips 34, 35 are mated with the outer wrap 30 so that the combined cigarette wrapper 36 is folded and formed with the tobacco while the cigarette wrapper formation is already in place. Such a design allows for the flexibility of combining various characteristics of the outer wrap layer and the partial inner wrap layer. Another benefit of the inline formation and processing of the cigarette with burn rate modification of the present invention is that it is an online method which does not affect the speed or formation of the actual cigarette. Thus, within the garniture, there is no significant modification required to form the cigarette rod which is cut into proper length and then added to filters at a later station within the cigarette maker.

As shown in FIG. 9, the inner wrap strips 34, 35 are fed into the garniture on the interior surface of the outer wrap 30 such that they are in proper placement when the cigarette maker forms the cigarette and tobacco column. In the present example, as shown in FIG. 3, the inner wrap strips 34, 35 are positioned at 90° from the seam of the outer wrap 30 and may be placed equidistant from each other in order to provide a smooth and continuous burn rate modification for the cigarette. The inner wrap material may be placed on the interior side of the outer wrap 30 without adhesive as preferred but other position maintaining material may be used. Formation of the cigarette within the garniture 40 and compacting of the tobacco into the tobacco rod maintains the placement of the inner wrap strips 34, 35.

Figure 10:
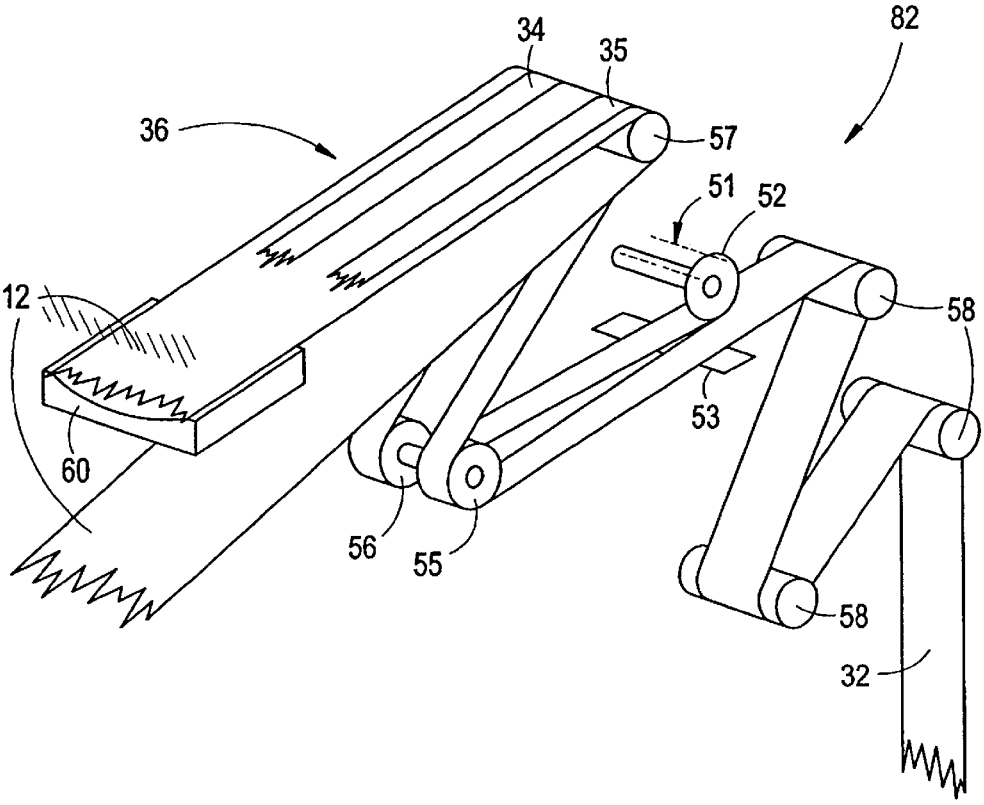
FIG. 10 is a perspective view of an alternative embodiment of the cigarette wrapper formation point of a cigarette making machine for use with the present invention.

Turning to FIG. 10, an alternative embodiment for the paper feeding assembly 82 is shown. In this embodiment, the outer wrap 12 is fed from a standard position to bullet roller 57 which directs the cigarette wrappers to the garniture 60 for formation of the cigarette. In this instance, the outer wrap 12 may be standard 27 mm wide cigarette paper and have normal porosity as well as other typical additives. As is depicted, the combined partial double wrap 36 which may be combined prior to the garniture is formed from the combination of the outer wrap 12 and the dual line inner wrap strips 34, 35.

As can be seen, the inner wrap strip paper 32 from the bobbin is fed to the guide rollers 58 prior to cutting or slitting by rotary cutter 51. The rotary cutter may be comprised of a rotary knife 52 and knife block 53. In such a formation, it is desirable to have a 8 mm wide combined portion of the interior of the cigarette covered with the partial double inner wrap, an inner wrap 32 may be provided which is slit in half forming equal 4 mm wide strips 34, 35. These strips may be formed by rotary cutter 51 and separated by separation rollers 55, 56 before the partial inner wrap strip 34, 35 are combined with the outer wrap paper 12 at the roller 57. The inner wrap 32 of course may be slit into even narrower strips for overlaying onto the outer wrap.

A benefit of such a design is that a rotary cutter 51 may be provided for slitting the paper into the desired widths. Problematic in handling narrow strips thereby necessitating the guide and tensioning rollers is that after the narrower strips are formed, care must be provided to prevent tearing of the inner wrap paper 32 and individual strips 34, 35. Thus, it may be beneficial to provide a rotary cutter 51 at a point which is fairly close or adjacent to the garniture 60 in order to prevent significant handling of the narrow inner wrap strips 34, 35.

In the paper feeding assembly 82 shown in FIG. 10, a rotary cutter 51 is shown to form the strips 34, 35 from the original web of material 32. A number of different cutting devices or slitters may be used in all of these embodiments such as a static knife, laser, rotary knife as depicted, water jet cutter, kiss cutting or micro-perforation formation. Additionally, pre-formed webs of material may be provided which are pre-cut into individual strips which may then be separated prior to feeding into the garniture through various handling devices. A number of differing embodiments may be utilized in order to feed the appropriate inner wrap strips into the garniture in combination with the outer wrap. While the various embodiments disclosed herein teach specific structure to accomplish the feeding of the inner wrap strips to the garniture, a number of embodiments may be provided for formation or supplying of the inner wrap strips to the garniture in combination with the outer wrap. Such variations are felt to fall within the teachings of the present application and no unnecessary limitation is to be interpreted from the specific examples of the paper feeding assembly setforth herein.

Figure 11:
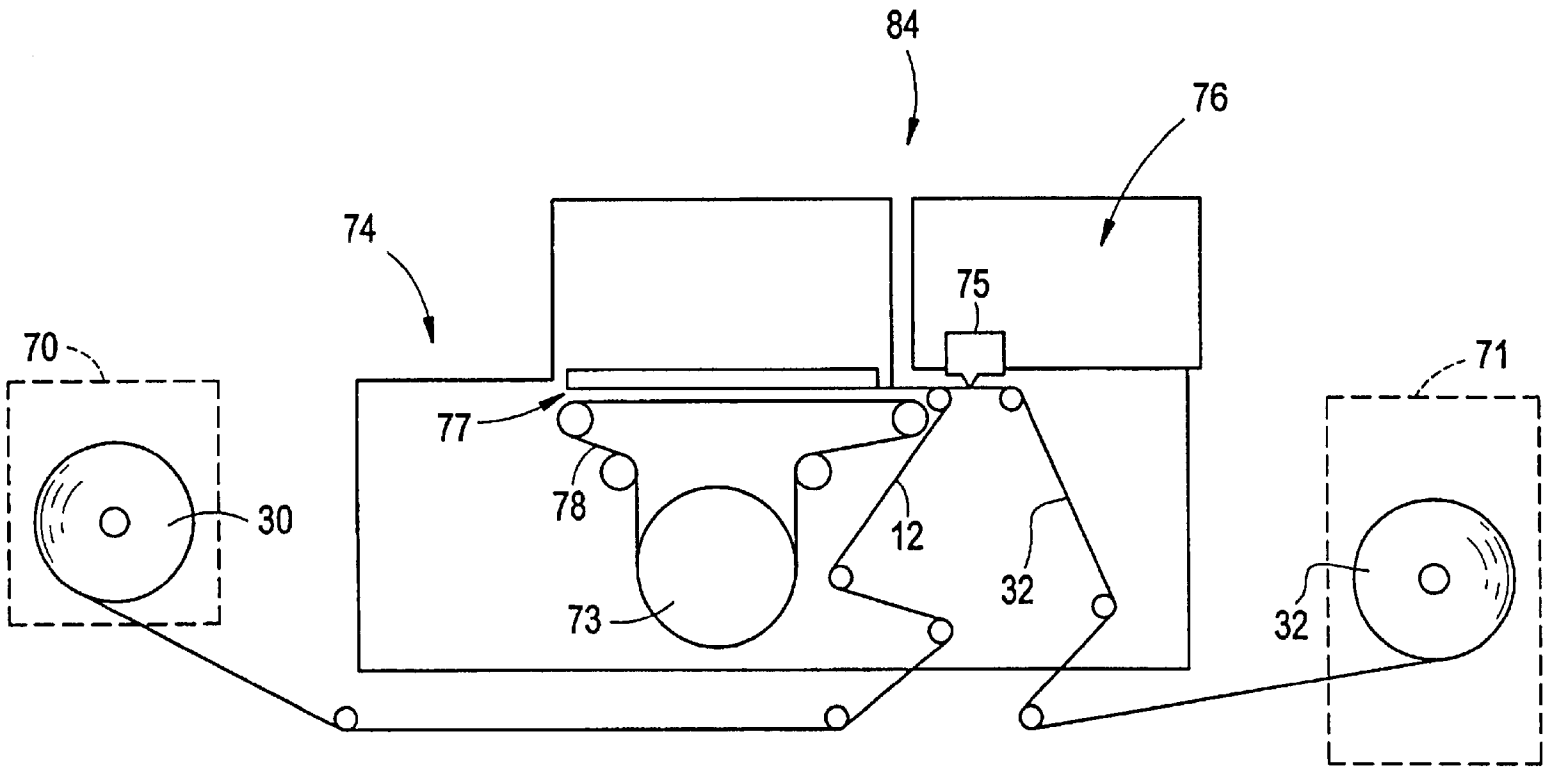
FIG. 11 is a side view of an alternative embodiment for formation of the cigarette wrapper for use with the present invention.

As disclosed in FIG. 11, an additional embodiment 84 is provided wherein a cigarette maker 74 may have external bobbin units 70, 71. External bobbin unit 70 may have bobbin 30 which supplies the outer wrap paper to be fed into the garniture 77. The bobbin 30 provides a web of material 12 which is fed into the garniture and combined with a web of material 32 which forms the inner wrap strips. External bobbin unit 71 may have a bobbin of material 32 which is fed to a knife mechanism 75 for slitting. The slitter or cutting mechanism 75 is positioned directly adjacent to the garniture 77 in order to decrease the length of handling of the individual narrow inner wrap strips. As shown, the maker 74 has garniture 77 and garniture belt 78 driven by drive shaft 73 which feeds the paper and tobacco material through the garniture during the cigarette formation process such that the tobacco rod and cigarette is formed with the inner wrap strips formed therein.

As may be appreciated, provision for an external bobbin unit 70, 71 for both the outer wrap and inner wrap material allows for easier online processing of the paper and ready integration into the cigarette maker 74 of the partial inner wrap strips. Additionally, external placement of the outer wrap bobbin 30 and inner wrap bobbin 32 requires minimal changing of the structure for the cigarette maker 74 as the bobbins may be spaced away from the maker 74 and no significant changes are required at the area around the garniture 77 apart from the guide and tensioning rollers. Additionally, external bobbin units are currently implemented with cigarette makers and may be provided for in order to combine the outer and partial inner wrap strips of the present invention in order to create the appropriate burn rate modification desired.

In use, the external unit 71 may be fitted with a spool of bandcast material instead of a standard bobbin of cigarette wrapper. A spool may be utilized due to the non-uniformity of the material in bandcast. A spool having bandcast recon may be used wherein the material is 8 mm in width and is fed into the maker 74 through guide rollers in order to minimize movement of the bandcast material as the spool is unwound. The material may be slit immediately prior to joining with the outer wrap material at the bullet roller which is the roller typically found at the first or beginning part of the garniture. A plurality of guide rollers and tensioning rollers may be provided to properly feed the material to the garniture and combine it with the outer wrap material.

The cigarette with burn rate modification of the present invention may be designed with variations in outer wrap and inner wrap paper characteristics. As previously explained, standard outer wrap designs are such that the typical outer wrap has a linear laid out width of 27 mm and generally a porosity of between 15 and 80 Coresta units. As is generally understood, significantly decreasing the outer wrap porosity changes the deliveries and linear burn rate of the cigarette. Modification of the standard burn rate for a normal or typical cigarette may be obtained through addition of a partial inner wrap to the cigarette. The partial inner wrap may be a single inner wrap portion or may be a plurality of inner wrap strips as shown in the various figures. The partial inner wrap may have paper characteristics with a significantly reduced porosity such that the inner wrap paper exhibits a porosity of less than 8 Coresta units. If a single inner wrap strip is utilized, such as with band cast or other paper as previously described and depicted in FIG. 6, the inner wrap layer may have a width of between 2–15 mm. The porosity of the inner wrap layer may be adjusted from any where to 0 to 8 Coresta units.

EXAMPLES

Several product examples were made using the construction of a partial strip wrap or partial inner wrap cigarette using the inventive techniques and construction described herein. In the examples, a control cigarette was used having no partial inner wrap strips which exhibited a linear burn rate of between 4.3–4.7 mm/min. Different materials where utilized, as detailed in the chart below, for the partial inner wrap strips ranging from standard treated paper to band cast tobacco material.

Examples of cigarettes with two band cast inner wrap strips having a porosity of band cast material less than 5 CORESTA units:

TABLE 1

| Cig. | Outer Wrapper Porosity CORESTA | Outer Wrap Citrate % | Inner Strips Number | Inner Strip Width mm | Linear Burn Rate (LBR) mm/min | Self Extin-guishment On 10 layers % |
|---|---|---|---|---|---|---|
| 1 | 50 | 0.5 | 0 | 0 | 4.3 | 0 |
| 2 | 50 | 0.5 | 2 | 4 | 3.1 | 100 |
| 3 | 50 | 0.5 | 2 | 5 | 2.6 | 100 |
| 4 | 50 | 0.5 | 2 | 6 | 2.7 | 100 |
| 5 | 40 | 0.7 | 0 | 0 | 4.7 | 0 |
| 6 | 40 | 0.7 | 2 | 3 | 3.8 | 48 |
| 7 | 30 | 0.6 | 0 | 0 | 4.3 | 0 |
| 8 | 30 | 0.6 | 2 | 4 | 3.1 | 100 |

Examples of cigarettes with two recon tobacco strips treated or covered with sodium alginate having a porosity of inner strip paper less than 5 CORESTA units:

TABLE 2

| Cig. | Outer Wrapper Porosity CORESTA | Outer Wrap Citrate % | Inner Strips Number | Inner Strip Width mm | Linear Burn Rate (LBR) mm/min | Self Extin-guishment On 10 layers % |
|---|---|---|---|---|---|---|
| 9 | 70 | 0.6 | 0 | 0 | 4.4 | 0 |
| 10 | 70 | 0.6 | 2 | 7 | 3.8 | 70 |

Examples of cigarettes detailing smoke deliveries of two samples with band cast strips:

TABLE 3

| Cig | Outer Wrapper Porosity CORESTA | Outer Wrap Citrate % | Inner Strip Number | Inner Strip Width mm | Linear Burn Rate (LBR) mm/min | Self Extinguishment On 10 layers % | tar mg/cig | Nicotine mg/cig | CO mg/cig | Puff Number |
|---|---|---|---|---|---|---|---|---|---|---|
| 11 | 70 | 0.6 | 2 | 4 | 3.9 | 90 | 15.5 | 1.4 | 12.2 | 10.3 |
| 12 | 50 | 0.5 | 2 | 4 | 3.8 | 90 | 14.5 | 0.9 | 14.6 | 7.3 |

In the examples presented, it is apparent that the addition of the partial inner wrap to the cigarette had a definite impact on linear burn rate and self extinguishment as compared to the control cigarette. The linear burn rate for the cigarettes using the present invention was directly affected and evidenced a reduction in linear burn rate by up to 40 percent. Where inner wrap strips were utilized having a width of at least 4 mm, test samples gave at least 90% self extinguishment. High self-extinguishment rates are seen using a plurality of 4 mm or greater strips of bandcast tobacco material but utilization of lower weight paper, such as standard cigarette paper, do not always appear to offer a high level of self extinguishment. Narrower width strips had differing results which could be modified by using alternative additives or increasing the number of strips. Reference to the self-extinguishment of the cigarette on 10 layers is related to the NIST test for cigarette ignition propensity.

Figure 12:
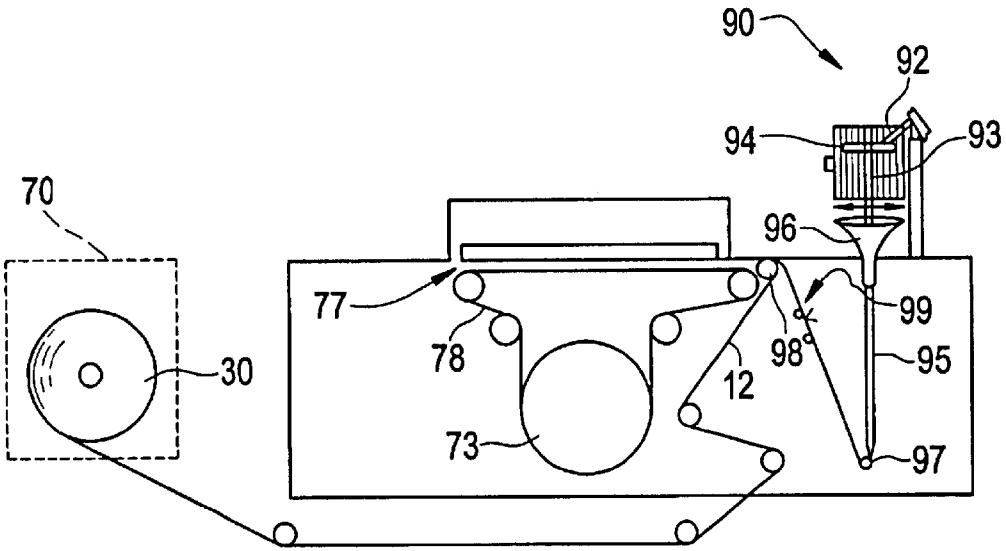
FIG. 12 is a frontal view of a cigarette making machine for formation of the cigarette wrapper of the present invention having an unroller mounted above the garniture.

In embodiments wherein the inner wrap strip is made of a heavier weight paper, placement of the secondary bobbin of inner wrap material becomes an issue. Due to the lower linear capacity of winding a unitary narrow strip of thicker material on a bobbin, the resulting bobbin may be significantly heavier and wider than a standard 27 mm wide outer wrap unitary layer bobbin. With the increased size and weight of the inner wrap bobbin for high speed on line implementation, the oversized inner wrap bobbin is preferably not placed directly on a cigarette maker in current paper locations, such as a standard double wrap cigarette manufacturing machine known in the art. In situations where high basis weight paper is utilized, such as with a band cast tobacco sheet for the inner wraps strip having a basis weight of, for example, 100 gsm and 0 coresta, wrapping the material onto a unitary layer strip bobbin is impractical. While wrapping such material on a unitary layer bobbin, the unitary layer strip bobbin becomes unstable after only 1,500 to 3,000 linear feet of material. The bobbin is susceptible to unraveling caused by any transverse force at the outer edge of the wound material due to the narrow width. One solution is winding the narrow strip material onto a transverse wound bobbin or spool 92, as is shown in FIG. 12, so that unwinding of the material causes the unwound strip to traverse back and forth along the central axis of the bobbin. Positioning of these wider and heavier transverse wound bobbins or spools becomes problematic on a cigarette making machine due to the width of the transverse wound bobbin, the weight of the bobbin and the transverse movement of the unwound strip into the cigarette maker.

As is shown in FIG. 12, an alternative embodiment of an unrolling device 90 is shown in combination with the apparatus of the present invention which provides stabilization of the transverse wound bobbin web of material 95 into the garniture 77. The unrolling device 90 depicted allows loading of the transverse wound bobbin or spool 92 above the garniture and feeding of the inner wrap strip web of material 95 to the bullet roller 98 in stable alignment.

As can be seen, the transverse wound bobbin 92 can be mounted on the cigarette maker so that it can unwind as the cigarettes are formed within the maker at high speeds. The transverse wound bobbin 92 may roll freely on a hub mounted on the unrolling device 90. The narrow, about 12 mm or less, inner wrap web of material 95 is unwound from the transverse wound bobbin 92, across the tensioning bar 94 held on tension arm 93, and though a funnel or stabilizer 96. Of particular concern in unrolling of the transverse wound bobbin 92 is that the inner wrap web of material 95 reciprocates across the central axis of the bobbin 92 as it is unwound. In the embodiment shown in FIG. 12 and FIG. 13, the unrolling device 90 is comprised of the support arm, tension arm 93 and tensioning bar 94. The tensioning arm 93 is mounted and attached to the support arm by a center focal point and may rise or lower based on the tension of the strip 95 and the tensioning spring 97*a* Tension arm 93 tensions the web of material indirectly by allowing the spool to spin more freely and may act as a break for the spool and in addition to this tensioning of the paper, it prevents the transverse wound bobbin from free wheeling when the machine stops thereby preventing the bobbin from throwing off a large amount of paper as it comes to rest.

As the inner wrap web of material 95 unwinds from the transverse wound bobbin 92, the unwound web of material 95 travels across the tensioning bar 94, tension bar 94 therefore potentially being as wide as the bobbin 92 to accept the transverse movement of the unwound web of material. Due to the reciprocating transverse movement of the unrolled web 95, the strip must be stabilized prior to feeding into the garniture. Failure to stabilize the inner wrap web of material may possibly cause the strip to tear in the cigarette maker based on incompatible tensioning. As shown in the drawings, a stabilizer 96, which may be similar to a funnel device in this embodiment, allows lateral movement along an upper portion thereof but restrains the strip in lateral motion at the lower and narrower exit portion. Upon exiting the funnel or stabilizer device 96, the inner wrap strip extends around intermediate roller 97 and is fed to the bullet roller 98 with the possibility of having a plurality of intermediate rollers therebetween depending on the necessity for proper tensioning. Interposed between roller 97 and bullet roller 98 is a slitter or cutting device 99 which may slit the narrow inner wrap web of material 95 into a plurality of narrower strips which are fed into the garniture 77 on the interior or upper surface of the outer wrap web of material 12 so that the inner wrap strips may be adjacent the tobacco column of the cigarette.

As is readily apparent from the drawings, the funneling or stabilizer device 96 constrains the reciprocating movement of the inner wrap web of material so that the web 95 is maintained in secure fashion so that the narrow web may be slit into a plurality of strips, preferably two, but up to four or more. The strips may be between about 3–6 mm each, depending on desired smoldering characteristics of the manufactured cigarette.

As mentioned, the unrolling device 90 disclosed herein may be necessary for various embodiments of heavy inner wrap strip material. With such heavy material, it has been found that only up to 1,500 feet on a standard unitary layer bobbin is the maximum length of material which can be placed on such a bobbin to function properly at high speeds due to the instability problems noted above. However, utilizing the transverse wound bobbin 92 as disclosed herein, approximately 6,000 to 120,000 linear feet of material may be stored and unwound for use in an online environment. If a large size transverse wound bobbin is utilized, it may be necessary to further use an external unwind motor or drive for the unrolling device 92 so that it unwinds in synchronization with the garniture belt 78 and the outer wrap strip 12 as opposed to a free spinning hub. Such unwinding motor may also be necessary in order to reduce the tension created by attempting to free spin such a high weight bobbin without an assist device.

Figure 13:
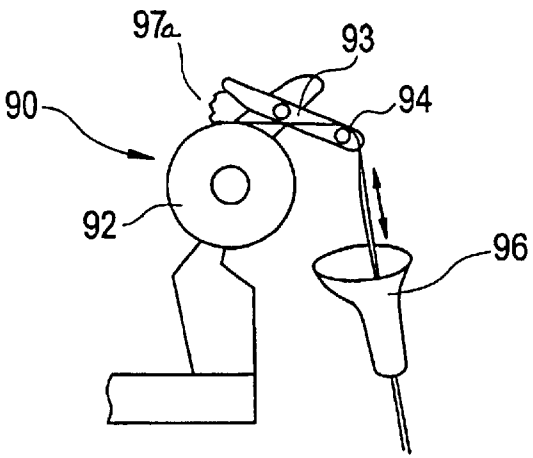
FIG. 13 is a close-up side view of the unroller mounted on the cigarette machine of the present invention shown in FIG. 12.

As seen in FIG. 13, the tensioning arm 93 may pivot about a center axis point by spring 97*a* so that the tension on the web 95 is alleviated and will not cause direct tearing of the paper like material. Additionally, the stabilizer device 96 may be any type of device which restrains the lateral movement of the inner wrap strip 95 and does not necessarily have to be funnel shaped as depicted. Significant other designs and embodiments may be utilized to provide the equivalent stabilizing characteristics as device 96 such that the inner wrap strip 95 may be fed to an intermediate roller 97 or be fed directly to the slitter 99 or the bullet roller 98 as necessary. Such alternative designs are contemplated within the overall structure disclosed herein and modifications made to the stabilizer device 96 which differ from that disclosed in the drawings are felt to fall within the teachings herein. For example, stabilizer device 96 may be replaced with a roller which causes the inner wrap strip to be rotated 90° so that the transverse movement across the transverse wound bobbin 92 is translated to rotational movement about a secondary roller 97 thereby preventing any axis-length movement along the axis of secondary roller 97.

Figure 17:
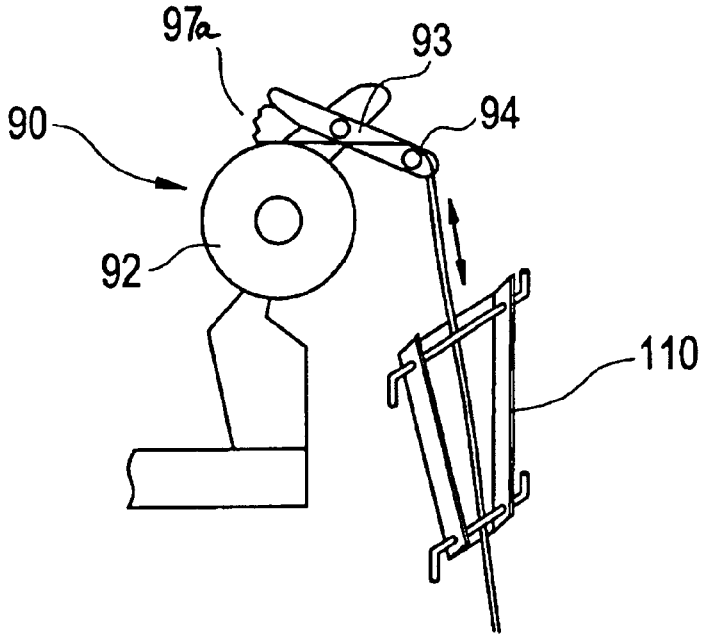
FIG. 17 is a side elevational view of the unrolling device and stabilizer of an alternative embodiment.
Figure 17A:
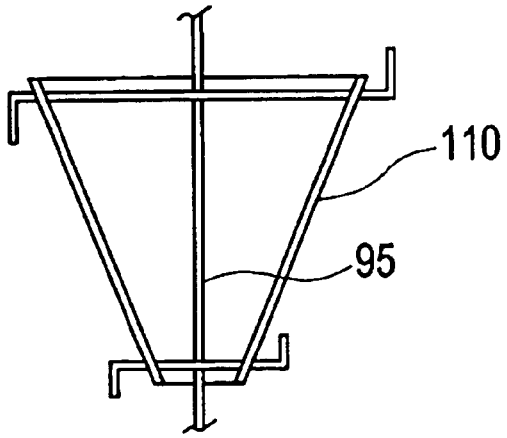
FIG. 17*a* is a front elevational view of the stabilizer of the embodiment shown in FIG. 17.

FIG. 17 depicts a stabilization device 110 of another embodiment for use with the present invention. As shown therein, the unrolling device 90 for the transverse wound bobbin 92 may be integrated with a triangular shaped pan 110 which restrains the lateral movement of the tape of the inner wrap web of material 95. The stabilizer device or triangular shaped pan 110, which is depicted in FIG. 17 and FIG. 17*a*, receives at its wider upper end the inner wrap web as it is fed from the transverse wound bobbin 92. As indicated previously, during unrolling of the transverse wound bobbin 92, the inner wrap web of material 95 reciprocates across the axis of the bobbin 92. The wider upper end of the stabilizing device 110 receives this reciprocating lateral movement and restrains such movement at its more narrower lower exit end such that a significant portion of any movement of the inner wrap web of material 95 is removed once the inner wrap strip is fed into the cigarette maker and possibly to an intermediate roller 97.

As shown, the triangular shaped pan or stabilizer device 110 may be mounted above the garniture area directly below or adjacent the unrolling device 90. As indicated, the pan or stabilizing device 110 is designed to reduce the amount of lateral movement which is caused by combining a transverse wound bobbin with the cigarette maker in an effort to stabilize the movement of the unwound inner wrap web of material 95 so that the positioning and tensioning of the strip 95 into the maker and garniture is normalized to allow for high speed manufacturing. As such, as shown in FIG. 17 and FIG. 17*a*, the triangular shaped pan allows for a wide entry area at an upper end, the width of which closely matches the reciprocating transverse movement of the inner wrap web of material off of the bobbin 92 and attempts to restrain, at the lower exit portion, the material so that very little lateral movement is noted within the maker. The pan or stabilizer device 110 may be mounted directly to the unrolling device or adjacent to the maker so long as the inner wrap strip 95 passes therethrough before entering into the maker or slitting device.

Figure 14:
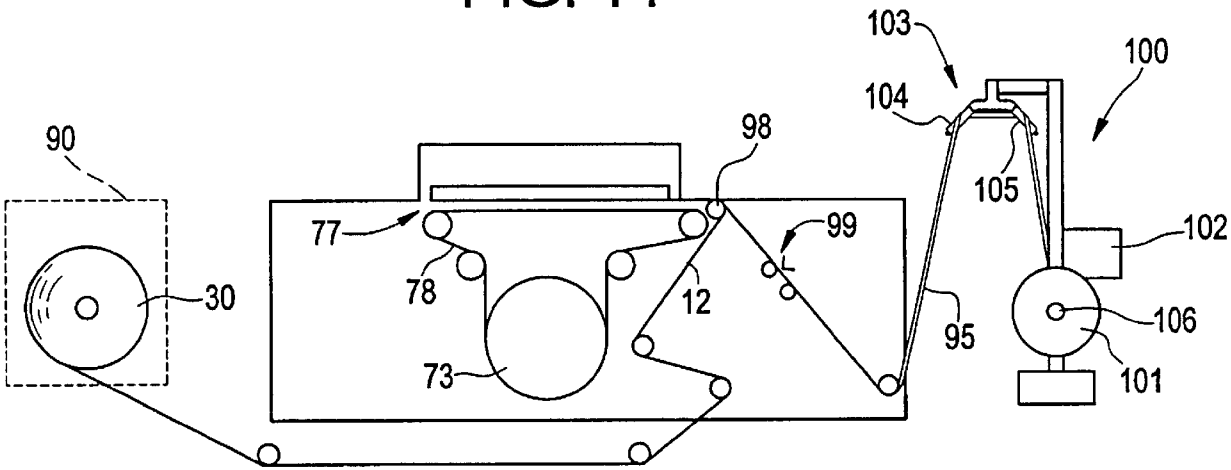
FIG. 14 is an alternative embodiment of the cigarette making machine for formation of the cigarette wrapper of the present invention with an external unrolling machine.
Figure 16:
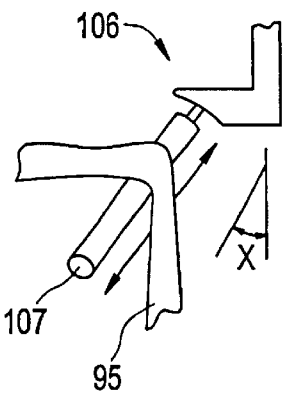
FIG. 16 is an alternative embodiment of the paper turning device of the present invention.
Figure 15:
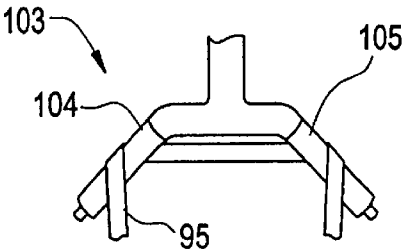
FIG. 15 is a close up view of the paper turning device shown in FIG. 14.

As shown in FIGS. 14, 15 and 16, an additional embodiment may be utilized for the unrolling device 100 when a larger transverse wound bobbin 101 of the inner wrap strip is utilized. As shown from the schematic of FIG. 14, the larger transverse wound bobbin 101 is mounted on hub 106 of the unrolling device 100. The hub may be a powerized hub driven by power motorized assist device 102 which is indirectly synchronized with the speed of the outer wrap web 12 and garniture belt 78. This synchronization is conducted through photo-diodes or sensors on the tensioning arm which constantly adjust the speed of the motorized assist device depending on the slack in the web of material and therefore the tension therein. As the inner wrap web of material is unwound from the bobbin 101, reciprocating movement of the inner wrap strip 95 along the axis of the bobbin is expected. Thus, the material may be passed to a paper turning or redirection device 103 which has a first roller 105 and second roller 104 in order to stabilize movement of the narrow strip of material 95. Thus, as the unwound strip reciprocates across the large transverse wound bobbin or spool of material 101, the reciprocating motion will be transferred along the first roller 105 and the second roller 104. However, once the inner wrap strip 95 extends to the cigarette maker and particularly the slitter 99, all lateral movement is removed and the narrow inner wrap web of material is stabilized. As shown, the paper turning device 103 is utilized to either completely remove the reciprocating motion of the narrower inner wrap web of material 95 caused by transverse unrolling along bobbin 101 or to turn material 95 in such a manner that the reciprocating motion is transferred to rotational movement about an intermediate roller 97. Thus, it is desirable to prevent movement along the axis of intermediate roller 97 by rotating the unraveled inner web of material 95 approximately 90° so that the reciprocating lateral movement is translated to reciprocating rotational movement about roller 97 thereby assuring stabilized positioning of the inner wrap strip to bullet roller 98 or slitter 99.

As also can be seen, the web of material may be fed to slitter 99 so that the web, prior to being fed to the bullet roller 98 and combined with the outer wrap paper 12, is slit into a plurality of narrower strips of material, preferably two strips but possibly four or more.

Returning to FIG. 15, the turning device 103 may be comprised of a first and a second roller extending downward at a displaced angle X from the vertical axis. Each of the rollers may be displaced off of the vertical axis by about 45°. The reciprocating movement of the unwound inner wrap strip prior to reaching the turning device 103 will travel along the length of the axis of the transverse wound bobbin 101. As such, first roller 105 may need to be sufficiently long enough to accommodate such movement such that the material will travel appropriately up and down the first roller 105. Such transverse movement along the first roller 105 may also partially be transferred to movement on the second roller 104. However, sufficient stabilization of the inner wrap strip 95 can be expected such that the paper is stabilized prior to reaching slitter 99.

An alternative embodiment is displayed in FIG. 16 wherein a single roller 107 is utilized at a displaced downward angle X of approximately 45° from the vertical axis. The roller 107 allows the narrow strip of material 95 to transverse back and forth, caused by the reciprocating action of the unwound material from bobbin 101, and turn the strip as desired. Roller 107 may necessarily be sufficient in length to meet these transverse reciprocating motions but not necessarily be the width of transverse wound bobbin 101 due to the angle with which it receives the strip from the bobbin.

As disclosed in FIG. 16, when a single roller 107 is utilized, positioning of the roller external to the cigarette machine may not necessarily require that the roller be displaced vertically from the machine as shown in other embodiments. Thus, the narrow inner wrap web of material 95 exiting the turning or redirection device 106 may enter into an intermediate roller directly adjacent the slitting device 99 so that it may be fed to bullet roller 98. An intermediate roller 97 may be necessary to receive the narrow inner wrap web of material prior to entry into the slitter 99 in order to further stabilize the material. Such a design may allow for support and unwinding of significantly larger transverse wound bobbins 101 which match or increase the length of material placed on a normal unitary layer outer wrap bobbin 30.

The transverse wound bobbin 101 and 92 depicted herein may contain a spool of band cast tobacco based material which is anywhere from 8 mm to 12 mm in width or less, depending on the number of strips required and other factors, such that a plurality of individual separated strips of paper may be fed to the bullet roller 98 adjacent the outer wrap strip 12. It is thought that individual inner wrap strips of 4 mm in width or less may work appropriately as outlined herein to adequately adjust the burn rate of a cigarette and also to enhance the flavor of the smoke or change the smoke characteristic, both main and side stream. By utilizing band cast material, specific benefits related to self extinguishment may be realized due to the weight of the paper and the porosity. Such bandcast material may be comprised of about 22% sodium alginate but which may have a range of between 7% to 30% content, and also having about 7% to 22% glycerin for proper characteristics. The transverse wound bobbins may be 10, 12, 20 inches in diameter or more depending upon the necessary linear requirements for proper feeding to the cigarette maker and manufacturing requirements. The motorized assist or power unroller motor 102 may be utilized as is shown in either embodiment for the heavier weight transverse wound bobbins, the motor assist devices integrated with the cigarette maker so that the unravel speed of the transverse wound bobbin matches that of the material of the outer wrap 12 being fed into the maker and garniture.

It is apparent that variations between the outer wrap and inner wrap porosity, width of the inner wrap, material used for the inner wrap and other factors will readily modify the burn rate of the cigarette, while still using concepts of the present invention. Such variations are deemed to fall within the teachings of the present application as generally, online addition of a partial inner wrap layer is described herein to properly modify the burn rate of a cigarette.

We claim:

1. An apparatus for forming a cigarette having a plurality of narrow inner wrap strips, comprising:

a first feeding path for a first web of material, said first web of material forming an outer wrap of a cigarette;

a second feeding path for a second web of material, said second web of material forming an inner wrap strip for said cigarette;

a slitter positioned in said second feeding path to slit said second web of material into a plurality of strips;

said apparatus having an unrolling device supporting a transverse wound bobbin of said second web of material, said unrolling device having a stabilizer, said second web of material extending from said bobbin and through said stabilizer to said slitter.

2. The apparatus for forming a cigarette having a plurality of narrow inner wrap strips of claim 1 wherein said unrolling device is mounted above and adjacent to a bullet roller, said bullet roller receiving said first web of material and said second web of material.

3. The apparatus for forming a cigarette having a plurality of narrow inner wrap strips of claim 1 wherein said unrolling device has a support arm for rotationally supporting said transverse wound bobbin and a tensioning arm, said tensioning arm having a tension bar over which said second web of material extends.

4. The apparatus for forming a cigarette having a plurality of narrow inner wrap strips of claim 1 wherein said stabilizer is a funnel device.

5. The apparatus for forming a cigarette having a plurality of narrow inner wrap strips of claim 1 wherein said stabilizer is a restraining pan.

6. The apparatus of claim 5 wherein said restraining pan is a triangular pan having a wide upper end and a narrow lower end.

7. A cigarette making apparatus for forming a cigarette having reduced ignition propensity, comprising:

a first feeding path for a first web of material from a bobbin, said first web of material forming an outer wrap of a cigarette;

a second feeding path for a second web of material from a transverse wound bobbin, said second web of material forming an inner wrap strip for said cigarette;

a slitter positioned in said second feeding path to slit said second web of material into a plurality strips;

an unrolling device rotatably supporting said transverse wound bobbin, said unrolling device having a triangular pan mounted adjacent said transverse wound bobbin, said second feeding path for said second web of material extending from said transverse wound bobbin across said triangular pan to said slitter.

8. A cigarette making machine for manufacture of a partial double wrap cigarette, comprising:

a garniture belt and a bullet roller adjacent a first end of said garniture belt;

a first bobbin of material feeding an outer wrap for a cigarette to said bullet roller and said garniture belt;

a second bobbin of material providing a web of an inner wrap material to said bullet roller and said garniture belt;

an unrolling device rotatably mounting said second bobbin of material, said web of inner wrap material extending from said second bobbin and around a tension bar on a tensioning arm;

a stabilizer having a wide upper end and a narrower lower end, said web of inner wrap material extending from said wide upper end to said narrow lower end;

a slitting device adjacent said bullet roller, said web of inner wrap material cut into a plurality of strips by said slitting device.

9. The apparatus of claim 8 wherein said stabilizer is a funnel shaped stabilizing device.

10. The apparatus of claim 8 wherein said stabilizer is a triangular pan.

11. The apparatus of claim 8 wherein said tension bar and tension arm of said unrolling device is comprised of a redirection device, said web of inner wrap material extending from said second bobbin and around said redirection device to an intermediate roller.

12. The apparatus of claim 11 wherein said unrolling device further includes a powerized drive motor for rotating said second bobbin of material.

13. The apparatus of claim 11 wherein said redirection device has a first roller extending downwardly at a predefined angle.

14. The apparatus of claim 13 wherein said predefined angle is about 45 degrees.

15. The apparatus of claim 11 wherein said redirection device has a first and a second roller, said inner wrap material extending around both of said first and said second roller.

16. A cigarette making machine in combination with a transverse wound bobbin of material, comprising:

an unrolling device for rotatably mounting said transverse wound bobbin, said transverse wound bobbin having an inner wrap web of material wound thereon;

a bullet roller at a first end of a garniture belt;

a outer wrap web of material wound on a outer wrap bobbin, said outer wrap web of material fed to said bullet roller;

a slitting device interposed between said bullet roller and said transverse wound bobbin;

wherein said inner wrap web of material has a predefined width which is less than a predefined width of said outer wrap web of material.

17. The combination of claim 16 wherein said unrolling device further includes a rotatable hub and a stabilizer device, said inner wrap web extending through said stabilizer device.

18. The combination of claim 17 wherein said stabilizer device is a funnel having an open upper end and a narrow exit end, said inner wrap web extending through said funnel.

19. The combination of claim 17 wherein said stabilizer device is a triangular pan having a wide upper and a narrow lower end.

20. The combination of claim 16 wherein said unrolling device rotatably mounts said transverse wound bobbin adjacent a redirection device, said inner wrap web extending from said transverse wound bobbin and around said redirection device to an intermediate roller before said slitting device.

21. A device for manufacturing a cigarette with inner wrap strips, comprising:

a cigarette maker having a garniture belt and a slitting device;

an outer wrap web of material wound on an outer wrap bobbin, said outer wrap web of material fed to said garniture belt of said cigarette maker;

an inner wrap web of material wound on a transverse wound bobbin, said inner wrap of material passing through said slitting device on said cigarette maker;

said inner wrap web of material wound on said transverse wound bobbin having a predefined width, said predefined width being less than a predefined width of said outer wrap web of material.

22. The device of claim 21 wherein said transverse wound bobbin has a diameter of at least 10 inches.

23. The device of claim 22 wherein said transverse wound bobbin is mounted above said garniture belt on an unrolling device, said unrolling device mounted onto said cigarette maker, a tensioning arm and a tensioning bar, said inner wrap web of material extending from said transverse wound bobbin around said tensioning bar to said slitting device.

24. The device of claim 21 wherein said inner wrap web of material is made of bandcast tobacco.

25. The device of claim 24 wherein said bandcast tobacco is made of between about 7% to 30% sodium alginate and about 7% to 22% glycerin.

26. The device of claim 21 wherein said transverse wound bobbin is mounted on an unrolling device, said unrolling device having a turning device, said outer wrap web of material extending from said transverse wound bobbin, around said turning device to said slitting device on said cigarette maker.

27. The device of claim 26 wherein said unrolling device further has a power unroller motor operably connected to a hub on which said transverse wound bobbin is mounted.

28. The device of claim 21 wherein said inner wrap web of material is 12 mm or less in width.

29. A cigarette making machine in combination with a transverse wound bobbin of material, comprising:

an unrolling device for rotatably mounting said transverse wound bobbin, said transverse wound bobbin having an inner wrap web of material wound thereon, said inner wrap web of material extending from said transverse wound bobbin over a tensioning bar and through a stabilization device;

a bullet roller at a first end of a garniture belt;

a outer wrap web of material wound on a outer wrap bobbin, said outer wrap web of material fed to said bullet roller;

a slitting device interposed between said bullet roller and said transverse wound bobbin;

wherein said inner wrap web of material wound on said transverse wound bobbin has a predefined width of 12 mm or less.

30. A cigarette making machine in combination with a transverse wound bobbin of material, comprising:

an unrolling device for rotatably mounting a transverse wound bobbin, said transverse wound bobbin having an inner wrap web of bandcast tobacco material wound thereon, said inner wrap web of material extending from said transverse wound bobbin over a tensioning bar and through a stabilization device;

a bullet roller at a first end of a garniture belt on said cigarette maker;

a outer wrap web of material wound on an outer wrap bobbin, said outer wrap web of material fed to said bullet roller and being about 27 mm in width;

a slitting device interposed between said bullet roller and said transverse wound bobbin, said inner wrap web of material extending from said transverse wound bobbin to said slitting device and said bullet roller;

wherein said inner wrap web of material wound on said transverse wound bobbin has a width of 12 mm or less, a porosity of less than 3 Coresta Units and a weight of greater than 70 GSM.

31. A cigarette making machine for making a cigarette having a reduced ignition propensity, in combination with an inner wrap bobbin of material, comprising:

a garniture area, garniture belt and bullet roller at a first end of said garniture area;

an unrolling device for mounting an inner wrap bobbin of material, said inner wrap bobbin of material having stored thereon an inner wrap web;

a stabilizer device receiving said inner wrap web and allowing said inner wrap web to extend there through;

an outer wrap bobbin of material having stored thereon an outer wrap web, said outer wrap web fed to said bullet roller;

wherein said inner wrap web is 13 mm or less in width.

* * * * *